US008579600B2

(12) United States Patent
Vijayakumar

(10) Patent No.: US 8,579,600 B2
(45) Date of Patent: Nov. 12, 2013

(54) SYSTEM AND METHOD FOR PORTABLE BATTERY BACK-UP SUMP PUMP

(75) Inventor: Senthilkumar Vijayakumar, Waukesha, WI (US)

(73) Assignee: Sta-Rite Industries, LLC, Delavan, WI (US)

( * ) Notice: Subject to any disclaimer, the term of this patent is extended or adjusted under 35 U.S.C. 154(b) by 709 days.

(21) Appl. No.: 12/413,279

(22) Filed: Mar. 27, 2009

(65) Prior Publication Data

US 2009/0269217 A1 Oct. 29, 2009

Related U.S. Application Data

(60) Provisional application No. 61/040,535, filed on Mar. 28, 2008.

(51) Int. Cl.
*F04B 35/06* (2006.01)

(52) U.S. Cl.
USPC ..... 417/234; 29/428

(58) Field of Classification Search
USPC ..... 417/234; 29/428
See application file for complete search history.

(56) References Cited

U.S. PATENT DOCUMENTS

| | | | | |
|---|---|---|---|---|
| 981,213 | A | 1/1911 | Mollitor | |
| 3,316,843 | A | 5/1967 | Vaughan | |
| 3,634,842 | A * | 1/1972 | Niedermeyer | 417/14 |
| 3,726,606 | A | 4/1973 | Peters | |
| 3,735,233 | A | 5/1973 | Ringle | |
| 3,753,072 | A | 8/1973 | Jurgens | |
| 3,814,544 | A | 6/1974 | Roberts et al. | |
| 3,910,725 | A | 10/1975 | Rule | |
| 3,941,507 | A | 3/1976 | Niedermeyer | |
| 3,972,647 | A | 8/1976 | Niedermeyer | |
| 3,987,240 | A | 10/1976 | Schultz | |
| 4,087,204 | A | 5/1978 | Niedermeyer | |
| 4,108,574 | A | 8/1978 | Bartley et al. | |
| 4,187,503 | A | 2/1980 | Walton | |
| 4,215,975 | A | 8/1980 | Niedermeyer | |
| 4,222,711 | A | 9/1980 | Mayer | |
| 4,228,427 | A | 10/1980 | Niedermeyer | |
| 4,233,553 | A | 11/1980 | Prince, Jr. et al. | |
| 4,255,747 | A | 3/1981 | Bunia | |
| 4,309,157 | A | 1/1982 | Niedermeyer | |
| 4,369,438 | A | 1/1983 | Wilhelmi | |
| 4,456,432 | A | 6/1984 | Mannino | |

(Continued)

OTHER PUBLICATIONS

FLOTEC, Owner's Manual, Battery Backup System, Apr. 16, 2004, pp. 1-44, Delavan, WI.

(Continued)

*Primary Examiner* — Joseph L Williams
*Assistant Examiner* — Andrew Coughlin
(74) *Attorney, Agent, or Firm* — Quarles & Brady LLP

(57) ABSTRACT

Embodiments of the invention provide a system and method for a backup sump pump kit. The kit is for use with a battery and an alternating current power source. The kit can be adapted to be a portable power source for an external electric device. The kit can include a portable case, a battery-operated back-up sump pump removably stored in the portable case, and a control charger integrated into the portable case. The control charger can include a battery chargers cables, a power input socket to charge the battery, and a power output socket to provide power from the battery to the external electric device. The portable case can include a handle and wheels.

16 Claims, 5 Drawing Sheets

(56) References Cited

U.S. PATENT DOCUMENTS

| | | | | |
|---|---|---|---|---|
| 4,529,359 | A | 7/1985 | Sloan | |
| 4,552,512 | A | 11/1985 | Gallup et al. | |
| 4,564,041 | A | 1/1986 | Kramer | |
| 4,652,802 | A | 3/1987 | Johnston | |
| 4,668,902 | A | 5/1987 | Zeller, Jr. | |
| 4,766,329 | A | 8/1988 | Santiago | |
| 4,789,307 | A | 12/1988 | Sloan | |
| 4,806,457 | A | 2/1989 | Yanagisawa | |
| 5,015,152 | A | 5/1991 | Greene | |
| 5,051,068 | A * | 9/1991 | Wong | 417/234 |
| 5,129,264 | A | 7/1992 | Lorenc | |
| 5,135,359 | A | 8/1992 | Dufresne | |
| 5,166,595 | A | 11/1992 | Leverich | |
| 5,222,867 | A | 6/1993 | Walker, Sr. et al. | |
| 5,234,319 | A | 8/1993 | Wilder | |
| 5,319,298 | A | 6/1994 | Wanzong et al. | |
| 5,349,281 | A | 9/1994 | Bugaj | |
| 5,352,969 | A | 10/1994 | Gilmore et al. | |
| 5,425,624 | A | 6/1995 | Williams | |
| 5,449,274 | A | 9/1995 | Kochan, Jr. | |
| 5,449,997 | A | 9/1995 | Gilmore et al. | |
| 5,522,707 | A | 6/1996 | Potter | |
| 5,529,462 | A | 6/1996 | Hawes | |
| 5,562,422 | A | 10/1996 | Ganzon et al. | |
| 5,629,601 | A | 5/1997 | Feldstein | |
| 5,640,078 | A | 6/1997 | Kou et al. | |
| 5,669,323 | A | 9/1997 | Pritchard | |
| 5,672,050 | A | 9/1997 | Webber et al. | |
| 5,708,348 | A | 1/1998 | Frey et al. | |
| 5,712,795 | A | 1/1998 | Layman et al. | |
| 5,780,992 | A | 7/1998 | Beard | |
| 5,906,479 | A | 5/1999 | Hawes | |
| 5,986,433 | A | 11/1999 | Peele et al. | |
| 6,125,883 | A | 10/2000 | Creps et al. | |
| 6,146,108 | A | 11/2000 | Mullendore | |
| 6,150,776 | A | 11/2000 | Potter et al. | |
| 6,184,650 | B1 | 2/2001 | Gelbman | |
| 6,188,200 | B1 | 2/2001 | Maiorano | |
| 6,198,257 | B1 | 3/2001 | Belehradek et al. | |
| 6,203,282 | B1 | 3/2001 | Morin | |
| 6,257,833 | B1 | 7/2001 | Bates | |
| 6,364,620 | B1 | 4/2002 | Fletcher et al. | |
| 6,366,053 | B1 | 4/2002 | Belehradek | |
| 6,369,463 | B1 | 4/2002 | Maiorano | |
| 6,375,430 | B1 | 4/2002 | Eckert et al. | |
| 6,443,715 | B1 | 9/2002 | Mayleben et al. | |
| 6,481,973 | B1 | 11/2002 | Struthers | |
| 6,503,063 | B1 * | 1/2003 | Brunsell | 417/234 |
| 6,527,518 | B2 | 3/2003 | Ostrowski | |
| 6,638,023 | B2 | 10/2003 | Scott | |
| 6,676,382 | B2 | 1/2004 | Leighton et al. | |
| 6,789,024 | B1 | 9/2004 | Kochan, Jr. et al. | |
| 6,847,130 | B1 | 1/2005 | Belchradek et al. | |
| 6,854,479 | B2 | 2/2005 | Harwood | |
| 6,867,383 | B1 | 3/2005 | Currier | |
| 6,998,807 | B2 | 2/2006 | Phillips et al. | |
| 7,015,599 | B2 | 3/2006 | Gull et al. | |
| 7,100,632 | B2 | 9/2006 | Harwood | |
| 7,264,449 | B1 | 9/2007 | Harned et al. | |
| 7,307,538 | B2 | 12/2007 | Kochan, Jr. | |
| 7,309,216 | B1 | 12/2007 | Spadola, Jr. et al. | |
| 7,339,126 | B1 | 3/2008 | Niedermeyer | |
| 7,388,348 | B2 | 6/2008 | Mattichak | |
| 7,429,842 | B2 | 9/2008 | Schulman et al. | |
| 7,458,782 | B1 | 12/2008 | Spadola et al. | |
| 7,459,886 | B1 | 12/2008 | Potanin et al. | |
| 7,525,280 | B2 | 4/2009 | Fagan et al. | |
| 7,528,579 | B2 | 5/2009 | Pacholok et al. | |
| 7,612,529 | B2 | 11/2009 | Kochan, Jr. | |
| 7,746,063 | B2 | 6/2010 | Sabini et al. | |
| 7,755,318 | B1 | 7/2010 | Panosh | |
| 7,788,877 | B2 | 9/2010 | Andras | |
| 7,795,824 | B2 | 9/2010 | Shen et al. | |
| 7,808,211 | B2 | 10/2010 | Pacholok et al. | |
| D638,858 | S | 5/2011 | Johnson et al. | |
| 8,032,256 | B1 | 10/2011 | Wolf et al. | |
| 8,049,464 | B2 | 11/2011 | Muntermann | |
| 8,098,048 | B2 | 1/2012 | Hoff | |
| 2002/0000789 | A1 | 1/2002 | Haba | |
| 2003/0049134 | A1 | 3/2003 | Leighton et al. | |
| 2004/0035471 | A1 | 2/2004 | Harwood | |
| 2004/0094209 | A1 | 5/2004 | Harwood | |
| 2004/0231247 | A1 | 11/2004 | Thachenkery | |
| 2005/0156568 | A1 * | 7/2005 | Yueh | 320/128 |
| 2005/0248310 | A1 | 11/2005 | Fagan et al. | |
| 2005/0271517 | A1 | 12/2005 | Terrell | |
| 2005/0275530 | A1 | 12/2005 | Kates | |
| 2005/0281679 | A1 | 12/2005 | Niedermeyer | |
| 2006/0078435 | A1 | 4/2006 | Burza | |
| 2006/0093492 | A1 | 5/2006 | Janesky | |
| 2006/0176000 | A1 | 8/2006 | Schulman et al. | |
| 2006/0226997 | A1 | 10/2006 | Kochan, Jr. | |
| 2006/0269426 | A1 | 11/2006 | Llewellyn | |
| 2007/0080660 | A1 | 4/2007 | Fagan et al. | |
| 2007/0188129 | A1 | 8/2007 | Kochan, Jr. | |
| 2007/0258827 | A1 | 11/2007 | Gierke | |
| 2008/0031751 | A1 | 2/2008 | Littwin et al. | |
| 2008/0031752 | A1 | 2/2008 | Littwin et al. | |
| 2008/0229819 | A1 | 9/2008 | Mayleben et al. | |
| 2008/0296975 | A1 | 12/2008 | Shakespeare et al. | |
| 2008/0298978 | A1 | 12/2008 | Schulman et al. | |
| 2008/0313255 | A1 | 12/2008 | Geltner et al. | |
| 2009/0079394 | A1 | 3/2009 | Richards et al. | |
| 2009/0146610 | A1 | 6/2009 | Trigiani | |
| 2009/0208345 | A1 | 8/2009 | Moore et al. | |
| 2009/0269217 | A1 | 10/2009 | Vijayakumar | |
| 2010/0154534 | A1 | 6/2010 | Hampton | |
| 2010/0166570 | A1 | 7/2010 | Hampton | |
| 2010/0197364 | A1 | 8/2010 | Lee | |
| 2010/0207771 | A1 | 8/2010 | Trigiani | |
| 2010/0303654 | A1 | 12/2010 | Petersen et al. | |
| 2010/0308770 | A1 | 12/2010 | Michalske et al. | |
| 2011/0077875 | A1 | 3/2011 | Tran et al. | |
| 2011/0084650 | A1 | 4/2011 | Kaiser et al. | |

OTHER PUBLICATIONS

Liberty Pumps, Inc.; "PC Series Sump Pump Combo Series;" 2010; pp. 1-2; Bergen, NY.

ITT Corporation; "Red Jacket Water Products Installation, Operation & Parts Manual;" May 1, 2009; pp. 1-8; www.redjacketwaterproducts.com.

ITT Corporation; "Red Jacket Water Products RJBB/RJBB2 Battery Backup Sump Pumps;" May 2007; pp. 1-2; www.redjacketwaterproducts.com.

ITT Corporation; "Goulds Pumps SPBB/SPBB2 Battery Backup Sump Pumps;" May 2007; pp. 1-2; www.goulds.com.

ITT Corporation; "SPBB Battery Backup Pump;" 2008; pp. 1; www.goulds.com.

Glentronics Inc.; "Glentronics Home Page;" 2007; pp. 1-2; www.glentronics.com.

Joe Evans, PhD.; "Pump Ed 101 Lift station Level Control; Pumps & Systems Magazine; " Sep. 2007; pp. 1-5; www.pumped101.com.

Glentronics, Inc.; "The Basement Watchdog A/C-D/C Battery Backup Sump Pump System Instruction Manual;" 2010; pp. 1-19; Lincolnshire, IL.

Glentronics, Inc.; "The Basement Watchdog Computer Controlled A/C-D/C Sump Pump System Instruction Manual;" 2010; pp. 1-19; Lincolnshire, IL.

Pentair Water; "WaterAce Pump Catalog;" 2007; pp. 1-44; Delavan, WI.

* cited by examiner

SYSTEM AND METHOD FOR PORTABLE BATTERY BACK-UP SUMP PUMP

RELATED APPLICATIONS

This application claims priority under 35 U.S.C. §119 to U.S. Provisional Patent Application No. 61/040,535 filed on Mar. 28, 2008, the entire contents of which is incorporated herein by reference.

BACKGROUND

Newer residential homes with basements often have one or more built-in sump pits, which are holes designed to collect water that has accumulated around the home's foundation. Sump pumps are typically installed in the sump pits to remove any accumulated water. Such sump pumps are usually powered through the home's electrical system. Since power outages can occur as a result of heavy storms, when sump pumps are needed the most, many homes are also equipped with a secondary, battery-operated, back-up sump pump. The back-up sump pump is typically powered by a conventional 12-volt battery, such as a lead-acid car battery. The back-up battery is often connected to a trickle-charge battery charger in order to ensure the battery is charged when it is needed.

FIG. 1 shows a common installation of a primary sump pump 10 in a sump pit 12. When installing the primary sump pump 10, a check valve 14 is often installed downstream from a discharge 16 of the primary sump pump 10 to prevent flow of the water back into the sump pit 12. In the configuration of FIG. 1, a back-up sump pump would be installed such that the discharge of the back-up sump pump would "T" into a pipe 18, between the discharge 16 and the upper surface of the sump pit 12. In such a configuration, if the back-up sump pump were to turn on, the natural flow of water from the discharge 16 of the back-up sump pump would be down through the primary sump pump 10 and back into the sump pit 12 (i.e., the path of least resistance). Therefore, in conventional back-up sump pump installations, an installer must cut the pipe 18, pull the pipe 18 and the primary sump pump 10 out of the sump pit 12, and make sure there is a check valve at the discharge 16. If there is no check valve at the discharge 16 (e.g., because the check valve 14 was installed outside of the pit, as shown in FIG. 1), the installer must obtain another check valve, remove the pipe 18 from the primary pump 10, install the new check valve at the discharge 16, re-cut the pipe 18 to a suitable length, and glue/attach the pipe 18 to the new check valve.

In addition, once the back-up sump pump, the back-up battery, and the battery charger are installed, the back-up battery cannot be conveniently removed as such batteries are typically heavy and awkward to carry.

SUMMARY

Some embodiments of the invention provide a system and method for a back-up sump pump kit. The kit is for use with a battery and am alternating current power source. The kit can be adapted to be a portable power source for an external electric device. The kit can include a portable case, a battery-operated back-up sump pump removably stored in the portable case, and a control charger integrated into the portable case. The control charger can include a battery charger, cables, a power input socket to charge the battery, and a power output socket to provide power from the battery to the external electric device.

In some embodiments of the invention, a back-up sump pump kit can include a battery-operated back-up sump pump and a portable case for storing the battery and the battery-operated back-up sump pump. The portable case can include a first half and a second half formed from a single mold, a latch to releasably lock the first half to the second half when the portable case is closed, a handle positioned on a top portion of the portable case, and wheels positioned on a bottom portion of the portable case.

According to a method of the invention, the battery-operated back-up sump pump can be installed in a sump pit containing a primary sump pump. The method can include providing a back-up sump pump kit including the battery-operated back-up sump pump, a first check valve, a second check valve, and a T-joint. The method also can include cutting a discharge pipe extending from the primary sump pump in order to create a first end open toward the primary sump pump and a second end open toward the discharge pipe leading out of the sump pit. The method can further include installing the first check valve at the first end of the cut discharge pipe and installing the second check valve downstream from the battery-operated back-up sump pump. In addition, the method can include coupling the first check valve and the second check valve to the T-joint and coupling the T-joint to the second end of the cut discharge pipe.

DETAILED DESCRIPTION

Figure 1:
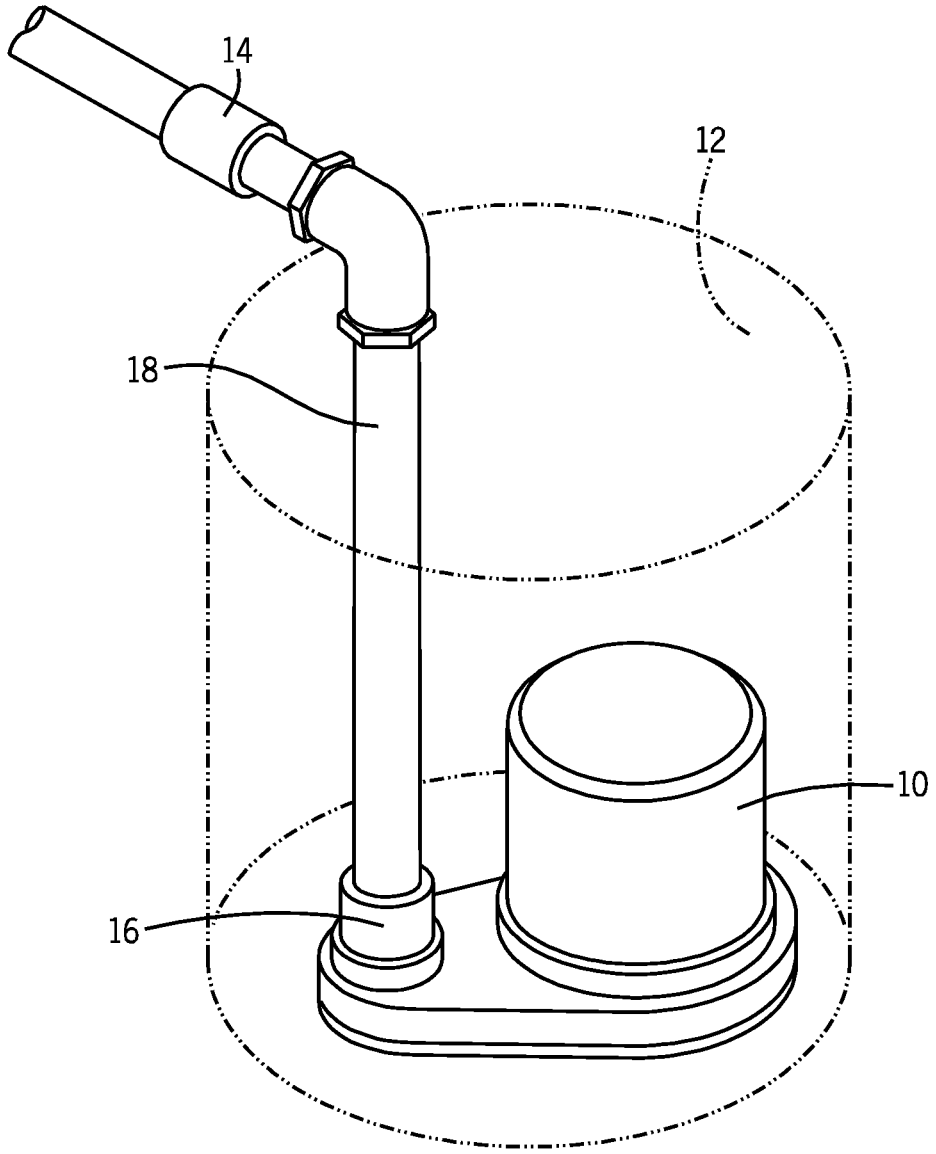
FIG. 1 is a perspective view of a prior art primary sump pump installation.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 2A:
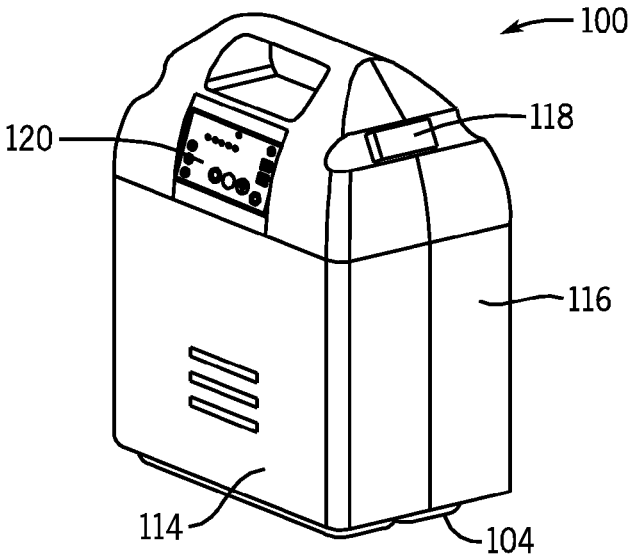
FIG. 2A is a perspective view of a back-up sump pump kit according to one embodiment of the invention.
Figure 2B:
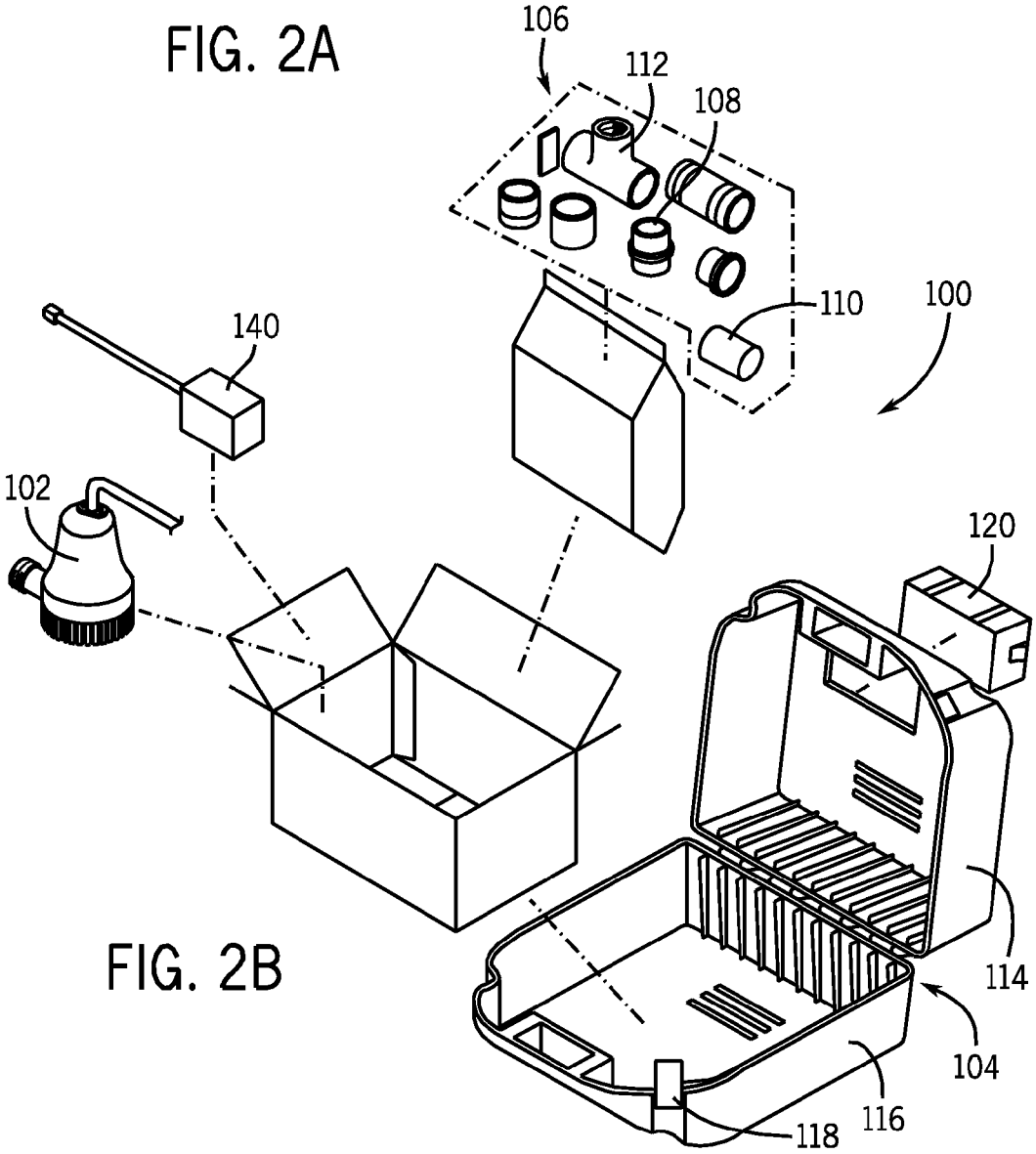
FIG. 2B is an exploded perspective view of the back-up sump pump kit of FIG. 2A.

FIGS. 2A and 2B illustrate a back-up sump pump kit 100 according to one embodiment of the invention. As shown in FIG. 2B, the kit 100 can include a back-up sump pump 102, a portable case 104, and plumbing components 106. The back-up sump pump 102 can be powered by a battery (not shown). In some embodiments, the battery can be a 12-volt direct current (DC) battery and can be placed and/or stored inside of the portable case 104. While conventional primary sump pumps 10 are powered using a home's electrical system, the battery-operated back-up sump pump 102 can be installed in a sump pit of a home to back up the primary sump pump 10 in the case of a power outage or other problem which prevents normal operation of the primary sump pump 11.

Figure 3:
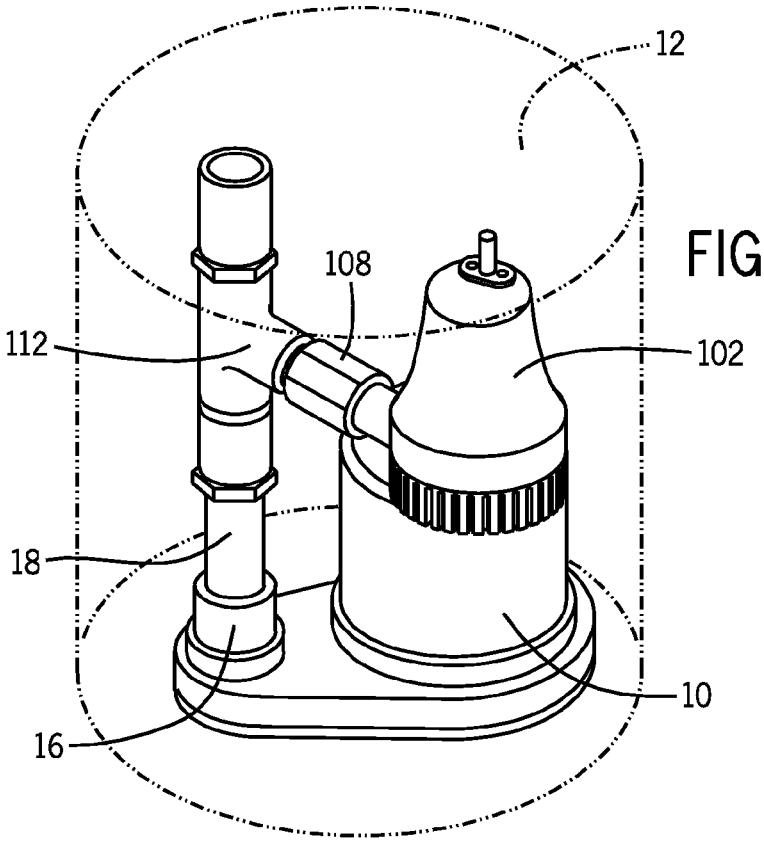
FIG. 3 is a perspective view of a back-up sump pump installed on top of a primary sump pump.
Figure 4:
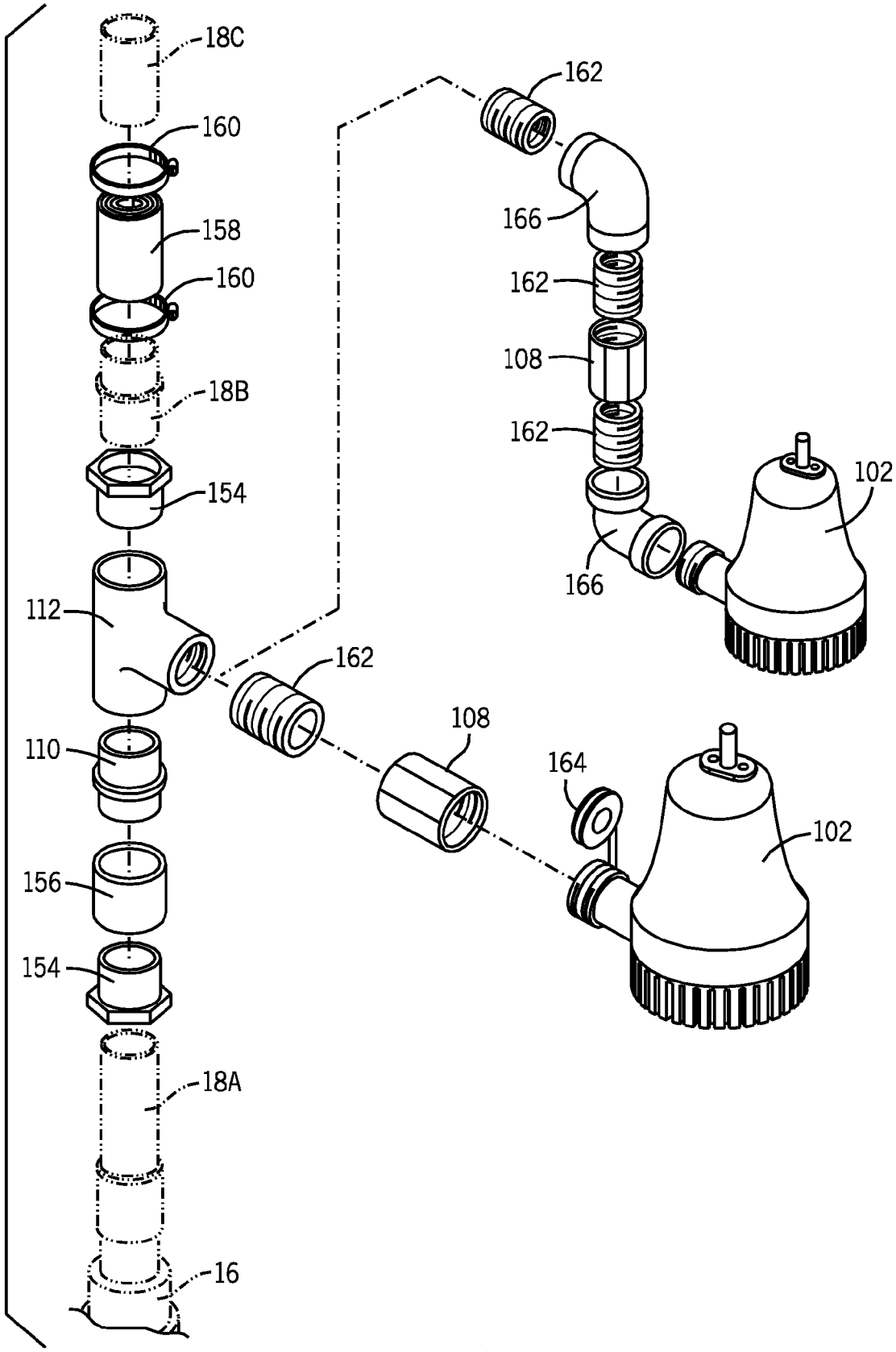
FIG. 4 is an exploded perspective view of the back-up sump pump and various plumbing components of the back-up sump pump kit of FIG. 2A.

The back-up sump pump 102 can be installed either on top of the primary sump pump 10 (i.e., a "top installation"), as shown in FIG. 3, or beside the primary sump pump 10 at the bottom of the sump pit 12 (i.e., a "side installation"). The location of the back-up sump pump 102 can be based on the size of the sump pit 12, among other factors. FIG. 4 illustrates both the top and side installations of the back-up sump pump 102. Both types of installations can require cutting the discharge pipe 18 downstream from the discharge 16 of the primary sump pump 10 and integrating the plumbing components 106.

The plumbing components 106 can be used to install the back-up sump pump 102 as shown in FIG. 4. The plumbing components 106 can be adapted to easily connect together, either through threading or through the use of additional hardware and adhesives. The plumbing components 106 can include two check valves 108 and 110, a T-joint 112, and various other connectors. For example, in both installations, as shown in FIG. 4, the discharge 16 can be connected to a bottom portion 18A of the discharge pipe 18, which can be connected to a slip reducer bushing 154 followed by a slip coupling 156, the check valve 110, the T-joint 112, another slip reducer bushing 154, a middle portion 18B of the discharge pipe 18, a hose coupling 158 with clamps 160, and an upper portion 18C of the discharge pipe 18. In the top installation, the back-up sump pump 102 can be coupled to the T-joint 112 by a close nipple 162, the check valve 108, and tape 164 (e.g., Teflon tape). In the side installation, the back-up sump pump 102 can be coupled to the T-joint 112 by the close nipple 162, an elbow connector 166, another close nipple 162, the check valve 108, and another elbow connector 166.

As shown in FIGS. 3 and 4, the check valve 108 can be coupled adjacent to a discharge of the back-up sump pump 102 in order to help prevent the flow of water back through the back-up sump pump 102. The check valve 110 can be coupled between the T-joint 112 and the discharge 16 of the primary sump pump 10. Through the integration of the check valve 110 into the kit 100, an installer can install the back-up sump pump 102 without having to remove the primary sump pump 10 from the sump pit 12, as must be done with conventional systems.

As shown in FIG. 2A, the portable case 104 can be made of plastic and can have a hinged clam-shell design. The portable case 104 can include two case halves 114 and 116. In some embodiments, the case halves 114 and 116 can be formed using a single mold (e.g., a single plastic mold). Due to the case halves 114 and 116 being formed from the same mold, the manufacturing costs of the portable case 104 can be considerably less than other case designs. The case halves 114 and 116 can include one or more latches 118 to secure the portable case 104 when closed.

In some embodiments, one of the case halves 114 or 116 can include an integrated control charger 120. The control charger 120 can be a combination control panel and battery charger for the kit 100. The battery charging component of the control charger 120 can be a 12-volt DC, 2-amp battery charger.

Figure 5A:
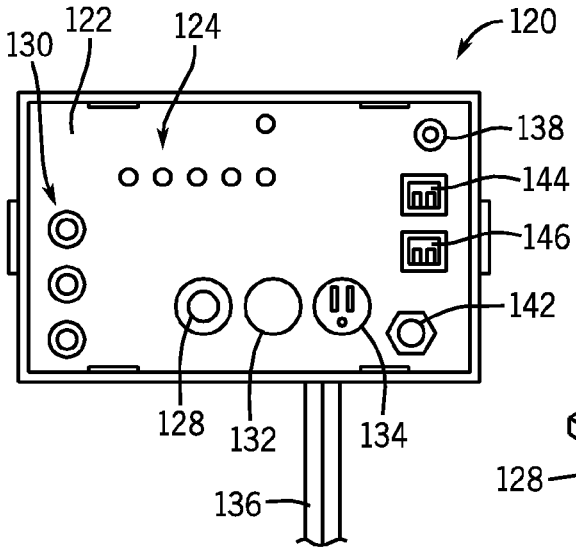
FIGS. 5A-5B are top and perspective views of a control charger of the back-up sump pump kit of FIG. 2A.
Figure 5B:
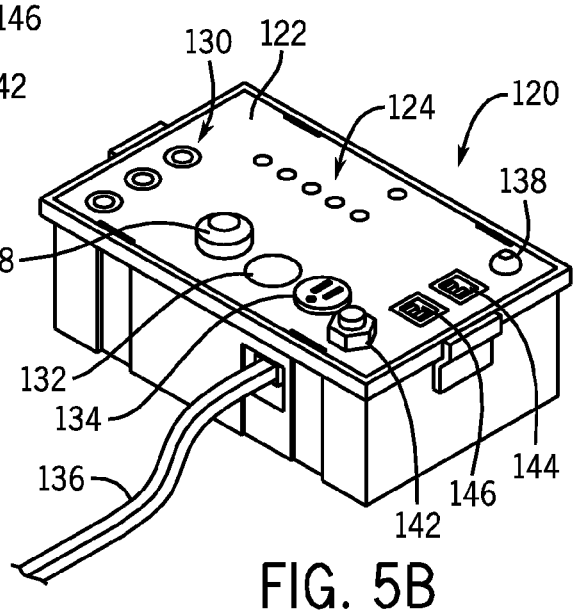
Figure 6:
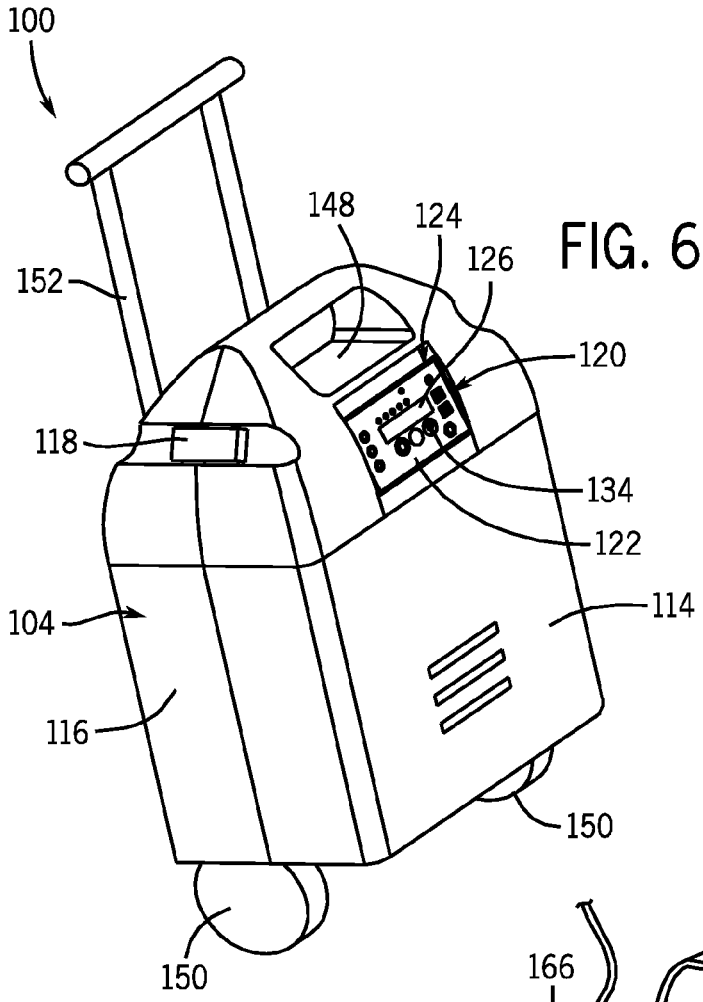
FIG. 6 is an exterior perspective view of a portable case of the back-up sump pump kit of FIG. 2A.

FIGS. 5A and 5B illustrate the control charger 120 according to one embodiment of the invention. The control charger 120 can include a display panel 122, as shown in FIG. 5A. The display panel 122 can include various indicator LEDs 124 to display function and status information to a user. For example, the indicator LEDs 124 can include a "Battery Status" LED, a "Silenced Audio Alarm" LED, a "Pump Status" LED, an "AC Power" LED, and a "System Alert" LED. Also, in some embodiments, the control charger 120 can include a flood light 128 on the display panel 122, which can serve as a utility light or as an emergency light in the event of a power outage. The flood light 128 can be an LED flood light or an incandescent, halogen, or fluorescent light bulb. In addition, in some embodiments, the display panel 122 can include a digital readout display 126 as an additional indicator of system parameters, as shown in FIG. 6.

As also shown in FIGS. 5A and 5B, the display panel 122 can include various buttons 130 (e.g., manual press down switches) for the user to control the system. The buttons 130 can include, for example, a "System Test" button, a "System Reset" button, a "Silence Alarm" button, and an "LED Flood Light On/Off" button. The control of the indicator LEDs 124, the flood light 128, and the buttons 130 on the display panel 122, as well as the control of the battery charging component of the control charger 120, can be executed by hardware and/or software stored within the control charger 120. Such hardware and/or software can also detect when a power outage occurs and can automatically turn on the back-up sump pump 102. In some embodiments, the control charger 120 can be controlled as described in United States Patent Application Publication No. 2007/0080660, published Apr. 12, 2007, the entire contents incorporated herein by reference.

In some embodiments, as further shown in FIGS. 5A and 5B, the control charger 120 can include a standard 12-volt DC output socket 132 located on the display panel 122. The DC output socket 132 can enable the control charger 120 to serve as a pass-through DC power supply. In addition, the control charger 120 can include a power inverter (not shown) and an alternating current (AC) outlet 134, so that the control charger 120 can also serve as an AC power source. The AC outlet 134 can also be located on the display panel 122, in some embodiments, as shown in FIGS. 5A-6.

Figure 7:
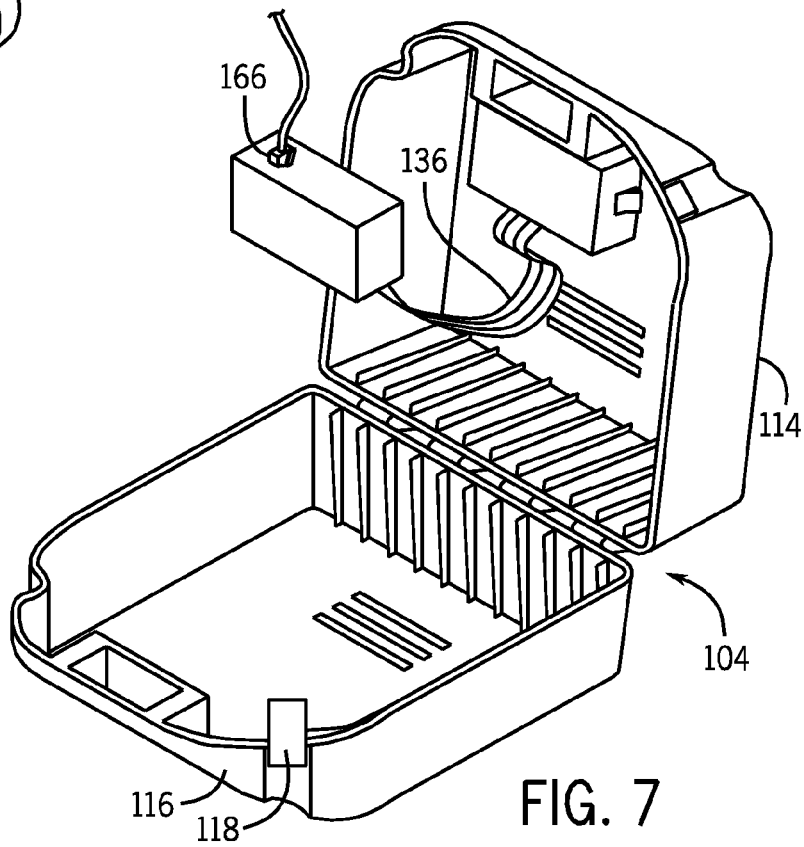
FIG. 7 is an interior perspective view of the portable case of the back-up sump pump kit of FIG. 2A.

The battery can be connected to the control charger 120 via cables 136 (as shown in FIGS. 5A-7) and can be stored inside the portable case 104. When the control charger 120 is integrated into the portable case 104, the cables 136 can be accessed from inside the portable case 104, as shown in FIG. 7. The battery can be a deep-cycle battery, such as a size 24M marine deep cycle battery (e.g., Flotec model FP12V27VCC), a size 27M marine deep cycle battery (e.g., Flotec model FP12V24DCC), or a 12-volt car battery. In some embodiments, the battery can also be an absorbed glass mat (AGM) battery. Some batteries can be provided with quick-connect leads that snap into terminals 166 (as shown in FIG. 7) coupled to the cables 136 of the control charger 120. This can eliminate the need for the user to touch live battery terminals.

As shown in FIGS. 5A and 5B, to charge the battery, the control charger 120 can include a power input socket 138. In some embodiments, the power input socket 138 can be located on the display panel 122. An AC charger, which can also be included in the kit 100, can electrically connect the power input socket 138 to an external AC power supply, such as an AC outlet (e.g., a 115-120 volt AC outlet delivering at least 15 amps). AC power can thus be supplied via the AC outlet, through the AC charger, through the power input socket 138 and converted to DC power via the power inverter within the control charger 120. DC power can then be supplied from the power inverter through the terminals on the control charger 120 and to the battery terminals to charge the battery. In some embodiments, the battery may need about 15 to over 100 hours to charge from a "dead battery condition" (i.e., 9 volts or less). Thus, the display panel 122 can include a battery charging status indicator on the digital display 126. Also, for protection from power spikes, a 20-amp circuit breaker 142 can be included in the control charger 120 and located on the display panel 122, as shown in FIGS. 5A and 5B.

As further shown in FIGS. 5A and 5B, quick connect tabs 144 can be included on the display panel 122 to electrically connect the back-up sump pump 102 to the battery inside the portable case 104 via internal cables (not shown). Additional quick connect tabs 146 can be included on the display panel 122 to electrically connect a float switch 140 (as shown in FIG. 2B) for the back-up sump pump 102 to the control charger 120. The boat switch 140 can also be included in the kit 100. Both sets of quick connect tabs 144, 146 can include positive and negative leads.

In some embodiments, as shown in FIG. 6, the portable case 104 can include a carrying handle 148, wheels 150, and/or a stroller handle 152. These additional components can be added by modifying one or both of the case halves 114, 116. In one embodiment, the stroller handle 152 can fold or telescope to allow for storage when not in use.

Accordingly, various embodiments of the invention provide for a convenient and portable back-up sump pump kit 100. The portable case 104 can store the battery inside and can include handles 148, 152 and/or wheels 150 for convenient portability. The portable case 104 can include the integrated control charger 120 that also serves as an AC and/or DC power source via the AC outlet 134 and/or the DC output socket 132, respectively. In some embodiments the portable case 104 including the battery can be used as a convenient, portable emergency power supply for electric devices other than the back-Lip sump pump 102. In the event of a power outage, the portable case 104 with the battery can be used anywhere in a household to power small electric devices.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A back-up sump pump kit for use with a battery and an alternating current (AC) power source, the kit adapted to be a portable power source for a battery-operated back-up sump pump and an external electric device, the kit adapted to be used with plumbing components to install the battery-operated back-up sump pump, the kit comprising:

a portable case;

the battery-operated back-up sump pump removably stored in the portable case when not installed for operation; and a control charger integrated into the portable case, the control charger including a battery charger adapted to be connected to the AC power source to recharge the battery, the battery to provide direct current (DC) power to the back-up sump pump when the back-up sump pump is installed for operation;

input power cables and output power cables adapted to be connected to the battery charger;

a DC to AC inverter; and a display panel, the display panel being viewable and accessible to a user when the portable case is closed, the display panel including an AC power input socket connected to the input power cables and adapted to be connected to the AC power source to charge the battery;

an AC power output socket coupled to the DC to AC inverter so the control charger can serve as an AC power source; and a DC power output socket connected to the output power cables and adapted to be connected to the external electric device in order to provide power from the battery to the external electric device.

2. The back-up sump pump kit of claim 1, wherein the external electric device is one of a light, a fan, and a dehumidifier.

3. The back-up sump pump kit of claim 1, wherein the control charger includes a flood light, the flood light being at least one of a light emitting diode, an incandescent light, a halogen light, and a fluorescent light.

4. The back-up sump pump kit. of claim 1, wherein the control charger includes a plurality of indicator light emitting diodes.

5. The back-up sump pump kit of claim 1, wherein the control charger includes a digital display.

6. The back-up sump pump kit of claim 1, and further comprising a float switch, and wherein the control charger includes quick-connect tabs to removably connect the float switch to the control charger.

7. The back-up sump pump kit of claim 1, wherein the control charger includes quick-connect tabs to removably connect the battery-operated back-up sump pump to the control charger.

8. The back-up sump pump kit of claim 1, wherein the control charger includes a circuit breaker to protect the battery from power spikes from the alternating current power source.

9. The back-up sump pump kit of claim 1, wherein the battery charger is a 12-volt DC, 2-amp battery charger.

10. The back-up sump pump kit of claim 1, wherein the DC power output socket is a 12-volt DC power output socket.

11. The back-up sump pump kit of claim 1, wherein the portable case includes at least one of a set of wheels, a carrying handle, and a stroller handle.

12. The back-up sump pump kit of claim 1, wherein the portable case includes two case halves, the two case halves being hinged together and formed from the same mold.

13. The back-up sump pump kit of claim 1, wherein the plumbing components include at least one of a check valve and a T-joint.

14. The back-up sump pump kit of claim 1, wherein the battery-operated back-up sump pump is installable in a sump pit for operation.

15. The back-up sump pump kit of claim 1, and further comprising a float switch, and wherein the display panel includes a quick-connect tab to removably connect the float switch to the control charger without opening the portable case.

16. The back-up sump pump kit of claim 1, wherein the display panel includes a quick-connect tab to removably connect the battery-operated back-up sump pump to the control charger without opening the portable case.

* * * * *